US011464088B2

(12) United States Patent
Gnam et al.

(10) Patent No.: US 11,464,088 B2
(45) Date of Patent: Oct. 4, 2022

(54) LEDS WITH SPECTRAL POWER DISTRIBUTIONS AND ARRAYS OF LEDS COMPRISING THE SAME

(71) Applicant: Electronic Theatre Controls, Inc., Middleton, WI (US)

(72) Inventors: Evan Gnam, Madison, WI (US); Wendy Luedtke, Brooklyn, NY (US); William R. Florac, Verona, WI (US); Isabel Coff, Madison, WI (US); David J. Cahalane, Dane, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 50 days.

(21) Appl. No.: 17/116,225

(22) Filed: Dec. 9, 2020

(65) Prior Publication Data

US 2021/0185779 A1 Jun. 17, 2021

Related U.S. Application Data

(60) Provisional application No. 62/946,846, filed on Dec. 11, 2019.

(51) Int. Cl.

| | |
|---|---|
| ***H05B 45/20*** | (2020.01) |
| ***F21K 9/64*** | (2016.01) |
| ***F21K 9/62*** | (2016.01) |
| ***H05B 45/40*** | (2020.01) |
| ***H05B 45/30*** | (2020.01) |

(52) U.S. Cl.

CPC ..... *H05B 45/20* (2020.01); *F21K 9/62* (2016.08); *H05B 45/30* (2020.01); *H05B 45/40* (2020.01)

(58) Field of Classification Search

CPC ..... H05B 45/10; H05B 45/20; H05B 45/30; H05B 45/40; F21K 9/00; F21K 9/23; F21K 9/62; F21K 9/64; F21Y 2115/00; F21Y 2115/10; F21Y 2113/13; F21Y 2105/00; F21Y 2105/18

See application file for complete search history.

(56) References Cited

U.S. PATENT DOCUMENTS

| | | | |
|---|---|---|---|
| 6,683,423 | B2 | 1/2004 | Cunningham |
| 8,403,523 | B2 | 3/2013 | Gerlach et al. |
| 9,198,252 | B2 | 11/2015 | Laski et al. |

(Continued)

FOREIGN PATENT DOCUMENTS

| | | | |
|---|---|---|---|
| EP | 3276680 | A1 | 1/2018 |
| WO | 2008129454 | A2 | 10/2008 |
| WO | 2018015246 | A1 | 1/2018 |

OTHER PUBLICATIONS

Extended Search Report issued from the European Ptent Office for related Application No. EP20213122 dated Apr. 23, 2021 (11 Pages).

(Continued)

*Primary Examiner* — Thai Pham

(74) *Attorney, Agent, or Firm* — Michael Best & Friedrich LLP

(57) ABSTRACT

A light fixture including a substrate and a plurality of light emitting diodes mounted on the substrate. The plurality of light emitting diodes includes a first light emitting diode having a peak wavelength within a range of 600 nanometers and 630 nanometers, and a full width at half maximum value of at least 140 nanometers.

17 Claims, 13 Drawing Sheets

(56) References Cited

U.S. PATENT DOCUMENTS

| | | | | |
|---|---|---|---|---|
| 2004/0218387 | A1 | 11/2004 | Gerlach | |
| 2012/0140463 | A1* | 6/2012 | Kinzer | F21V 7/043 362/231 |
| 2012/0300432 | A1 | 11/2012 | Matsubayashi et al. | |
| 2013/0075660 | A1* | 3/2013 | Yeh | C09K 11/0883 252/301.4 R |
| 2014/0301062 | A1* | 10/2014 | David | F21V 3/00 362/84 |
| 2015/0054415 | A1* | 2/2015 | Maxik | A61N 5/0618 315/192 |
| 2016/0178141 | A1* | 6/2016 | Bichler | F21S 10/02 362/84 |
| 2018/0338362 | A1* | 11/2018 | Petluri | C09K 11/7774 |
| 2020/0113022 | A1* | 4/2020 | Cahalane | F21K 9/64 |

OTHER PUBLICATIONS

American National Standard Institue (ANSI), "ANSI E1.48-2014 (R2019) A Recommended Luminous Efficiency Function for Stage and Studio Luminaire Photometry Photo/2013-5000r2a," Feb. 1, 2019, (15 pages).

American National Standard Institue (ANSI), "An American National Standard ANSI/IES TM-30-18 Addendum #1, Part 1 Annex E," publicly available at least as early as Oct. 4, 2019, (18 pages).

European Union Law, "Official Journal of the European Union, Commission Regulation (EU) 2019 of Oct. 1, 2019, laying down ecodesign requirements for light sources and separate control gears pursuant to Directive 2009/125/EC of the European Parliment and of the Council and repealing Commission Regulations (EC) No. 244/2009, (EC) No. 245/2009 and (EU) No. 1194/2012," <https://eur-lex.europa.eu/legal-content/EN/TXT/?uri=uriserv:OJ.L_.2019.315.01.0209.01.ENG&toc=OJ:L:2019:315:TOC>, Oct. 1, 2019, (35 pages).

LUMILEDS, "Luxeon C Color Line," <https://www.lumileds.com/products/color-leds/luxeon-c-colors>, web page publicly available at least as early as Nov. 26, 2019, representative copy filed with IDS was captured Mar. 2021, (2 pages).

LUMILEDS, "Luxeon Rebel Color Line," <https://www.lumileds.com/products/color-leds/luxeon-rebel-color>, web page publicly available at least as early as Nov. 26, 2019, representative copy filed with IDS was captured Mar. 2021, (2 pages).

LUMILEDS, "Luxeon Z Color Line," <https://www.lumileds.com/products/color-leds/luxeon-z-colors>, web page publicly available at least as early as Nov. 26, 2019, representative copy filed with IDS was captured Mar. 2021, (1 page).

* cited by examiner

| CCT | $R_f$ | $R_g$ | $R_{cs,h1}$ | $R_{f,h1}$ | ANNEX E | OUTPUT SPD | CRI | R9 | TLCI |
|---|---|---|---|---|---|---|---|---|---|
| 2450 | 88 | 97 | -6% | 87 | P2 \| V- \| F3 |  | 88 | 52 | 83 |

| CCT | $R_f$ | $R_g$ | $R_{cs,h1}$ | $R_{f,h1}$ | ANNEX E | OUTPUT SPD | CRI | R9 | TLCI |
|---|---|---|---|---|---|---|---|---|---|
| 2400 | 92 | 105 | 1% | 95 | P1 \| V3 \| F2 |   | 95 | 93 | 94 |
| 2700 | 93 | 103 | -2% | 95 | P2 \| V- \| F2 |   | 95 | 85 | 95 |
| 3000 | 93 | 101 | -4% | 93 | P2 \| V- \| F2 |   | 93 | 70 | 94 |

| CCT | $R_f$ | $R_g$ | $R_{cs,h1}$ | $R_{f,h1}$ | ANNEX E | OUTPUT SPD | CRI | R9 | TLCI |
|---|---|---|---|---|---|---|---|---|---|
| 3200 | 92 | 102 | 1% | 97 | P1 \| V3 \| F1 |  | 97 | 96 | 98 |
| 4500 | 93 | 101 | 2% | 94 | P1\| V3 \| F2 |  | 95 | 83 | 98 |
| 5600 | 92 | 101 | 4% | 91 | P1 \| V3 \| F2 |  | 94 | 69 | 97 |

| CCT | $R_f$ | $R_g$ | $R_{cs,h1}$ | $R_{f,h1}$ | ANNEX E | OUTPUT SPD | CRI | R9 | TLCI |
|---|---|---|---|---|---|---|---|---|---|
| 3200 | 96 | 103 | 0% | 97 | P1 \| V3 \| F1 |  | 97 | 99 | 94 |
| 4500 | 97 | 100 | 0% | 98 | P1\| V3 \| F1 |  | 98 | 99 | 95 |
| 5600 | 97 | 103 | 0% | 98 | P1 \| V3 \| F1 |  | 97 | 98 | 96 |

| CCT | $R_f$ | $R_g$ | $R_{cs,h1}$ | $R_{f,h1}$ | ANNEX E | OUTPUT SPD | CRI | R9 | TLCI |
|---|---|---|---|---|---|---|---|---|---|
| 3200 | 95 | 104 | 3% | 94 | P1 \| V3 \| F1 |  | 94 | 73 | 98 |
| 4500 | 96 | 101 | 0% | 97 | P1\| V3 \| F1 |  | 98 | 95 | 99 |
| 5600 | 95 | 100 | 0% | 96 | P1 \| V3 \| F1 |  | 98 | 97 | 98 |

LEDS WITH SPECTRAL POWER DISTRIBUTIONS AND ARRAYS OF LEDS COMPRISING THE SAME

CROSS-REFERENCE TO RELATED APPLICATIONS

This application claims the benefit of U.S. Provisional Patent Application No. 62/946,846, filed Dec. 11, 2019, the entire content of which is hereby incorporated by reference.

BACKGROUND

The present subject matter relates to light emitting diodes (LEDs) used for lighting, and specifically to the spectral power distributions (SPDs) of the individual LEDs and arrays comprising those LEDs.

SUMMARY

Performance of a light array depends, at least in part, on what emitters are utilized in the light array. The range of colors a light array can produce generally improves as more differently colored emitters and control channels are added. However, simply adding more differently colored emitters adds to the cost and complexity of the light array. Performance generally improves as more emitters and control channels are added, but the cost and complexity of the light array increases. Presented herein are custom LEDs with unique optical properties that combine to create light arrays with high performance and while maintaining low complexity (i.e., a low number of LED channels).

The disclosure provides a light fixture including a substrate and a plurality of light emitting diodes mounted on the substrate. The plurality of light emitting diodes includes a first light emitting diode having a peak wavelength within a range of 600 nanometers and 630 nanometers, and a full width at half maximum value of at least 140 nanometers.

The disclosure also provides a light emitting diode including a peak wavelength within a range of 600 nanometers and 630 nanometers, a full width at half maximum value of at least 140 nanometers, and a CIE 1931 (x,y) chromaticity coordinate with an x-value within a range of 0.430 and 0.550 and a y-value within a range of 0.423 and 0.477.

The disclosure also provides a light emitting diode including a peak wavelength within a range of 450 nanometers and 470 nanometers, a full width at half maximum value within a range of 40 nanometers and 60 nanometers, a dominant wavelength within a range of 450 nanometers and 472 nanometers; and an excitation purity within a range of 95% and 100%.

The disclosure also provides a light emitting diode including a peak wavelength within a range of 510 nanometers and 520 nanometers, a full width at half maximum value within a range of 30 nanometers and 40 nanometers, a dominant wavelength within a range of 510 nanometers and 520 nanometers; and an excitation purity within a range of 75% and 90%.

The disclosure also provides a light emitting diode including a peak wavelength within a range of 650 nanometers and 670 nanometers, a full width at half maximum value within a range of 30 nanometers and 55 nanometers, a dominant wavelength within a range of 640 nanometers and 655 nanometers, and an excitation purity within a range of 96% and 100%.

The disclosure also provides a light fixture including a substrate and a plurality of light emitting diodes mounted on the substrate. The plurality of light emitting diodes include a first channel with a first light emitting diode and a second light emitting diode. The second light emitting diode has a different peak wavelength than the first light emitting diode. The plurality of light emitting diodes also includes a second channel with a third light emitting diode and a fourth light emitting diode. The fourth light emitting diode has a different peak wavelength than the third light emitting diode.

Before any embodiments are explained in detail, it is to be understood that the subject matter described herein is not limited in its application to the details of construction and the arrangement of components set forth in the following description or illustrated in the following drawings. The subject matter described herein is capable of other embodiments and of being practiced or of being carried out in various ways.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers" and "computing devices" described in the specification can include one or more processing units, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10%, or more) of an indicated value.

Other aspects of the disclosure will become apparent by consideration of the detailed description and accompanying drawings.

DETAILED DESCRIPTION

Figure 1:
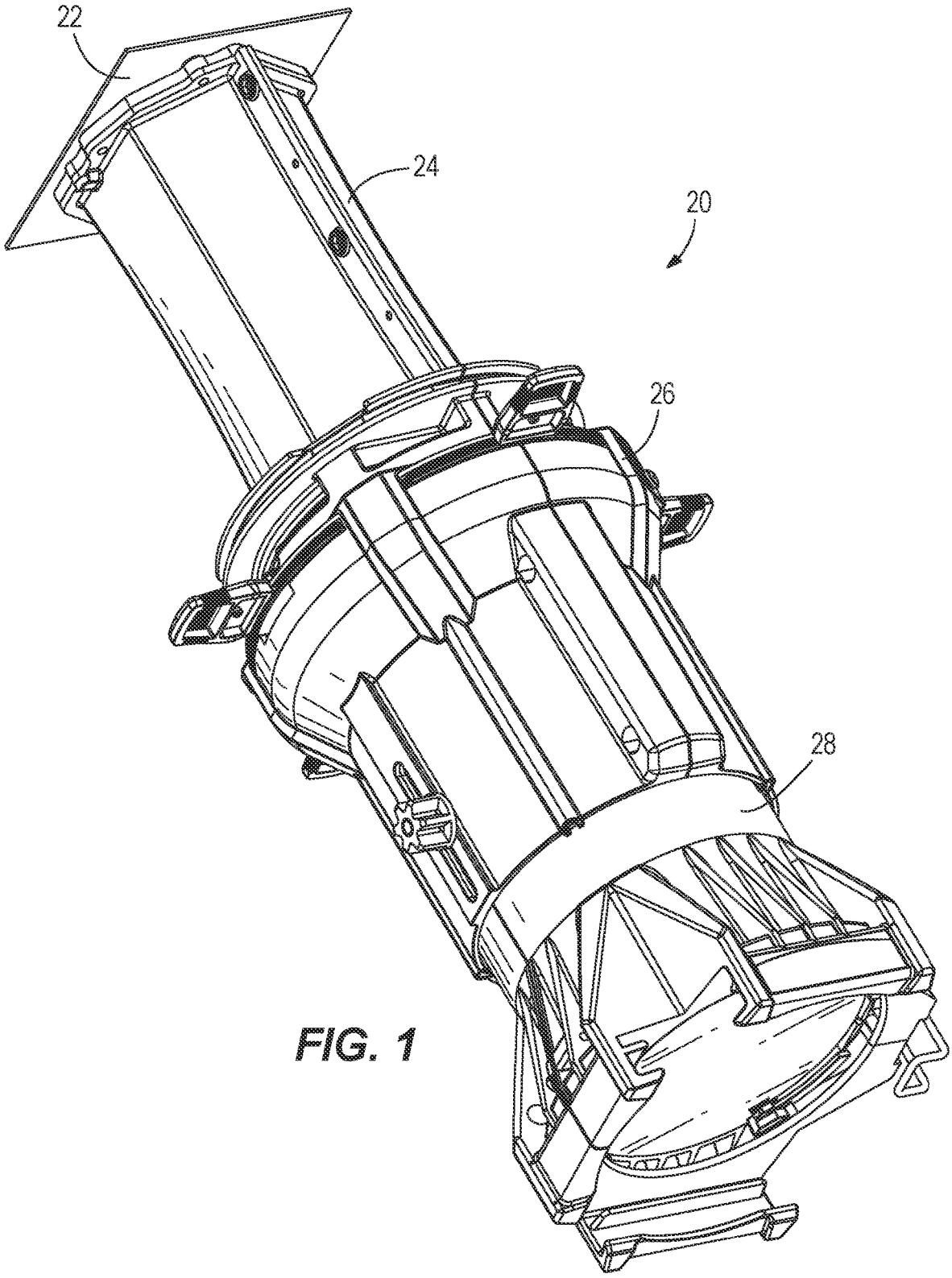
FIG. 1 is a perspective view of a light fixture according to one aspect of the disclosure.

With reference to FIG. 1, a light fixture 20 (i.e., a luminaire) is illustrated. In some embodiments, the light fixture 20 is for use in entertainment lighting, such as in a theatre or studio. In some other embodiments, the light fixture 20 may be for architectural use. The lighting fixture 20 includes a light source 22 that produces light (e.g., a plurality of LEDs), a mixing assembly 24 that mixes the light, a gate assembly 26 through which the light passes after exiting the mixing assembly 24, and a lens assembly 28 that receives the light from the gate assembly 26 and projects it toward the desired location.

Figure 2:
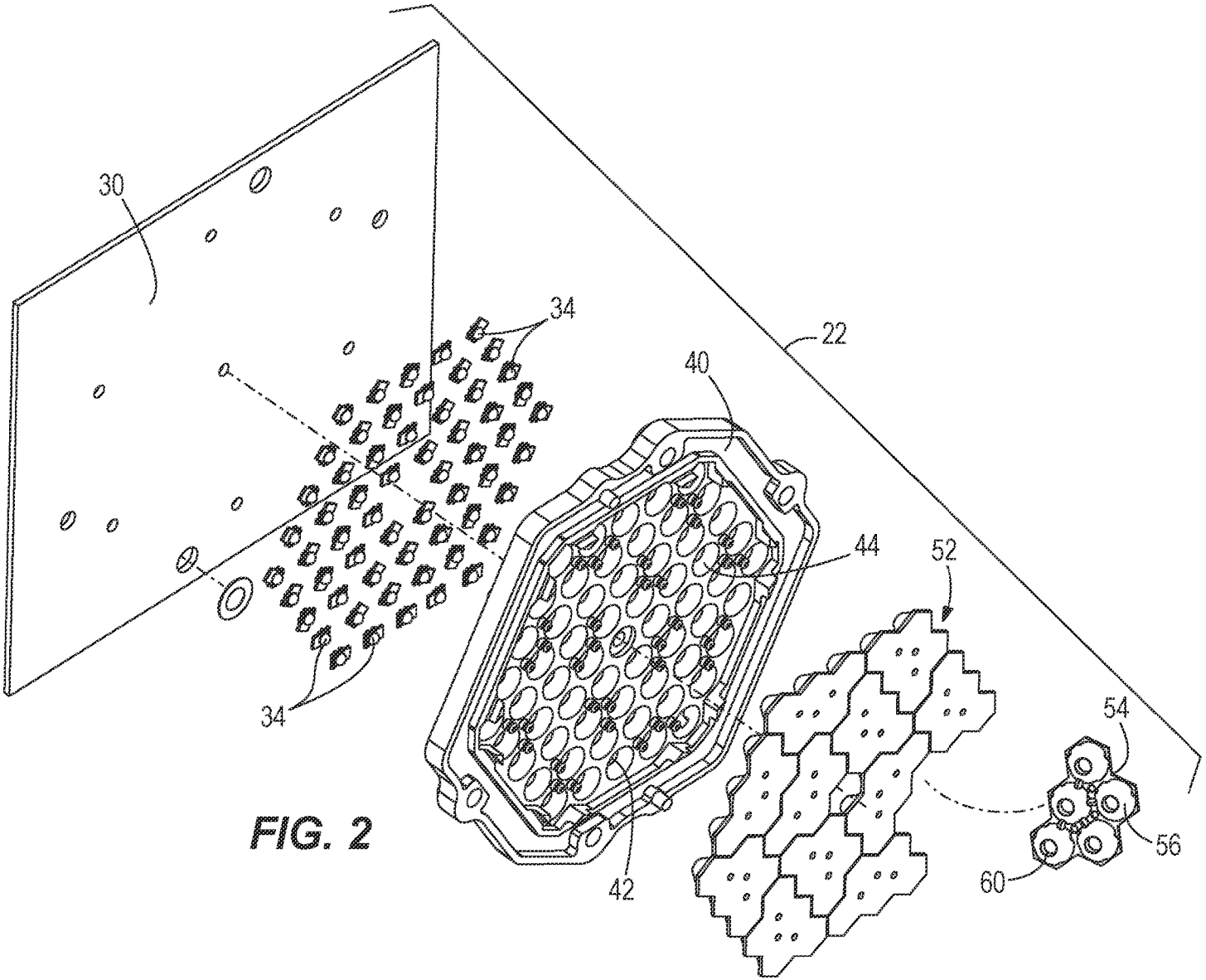
FIG. 2 is an exploded view of a LED assembly of the light fixture of FIG. 1.

With reference to FIG. 2, one example of the light source 22 is illustrated with a plurality of LEDs that produces light in multiple wave lengths. The light source 22 includes a substrate in the form of a printed circuit board 30 supporting a plurality of the LEDs 34 arranged in a hexagonal array. In the illustrated embodiment, the hexagonal array includes sixty LEDs 34, with five LEDs 34 arranged along each side of the six-sided array. The array is sixty-nine millimeters side-to-side and eighty millimeters corner-to-corner. Each LED 34 is spaced from the adjacent LEDs 34 by a distance of about ten millimeters, and there is no LED at the center of the array. It should be understood that the precise type, number, and positioning of the LEDs can be modified substantially without departing from the teachings of the present invention.

With continued reference to FIG. 2, a primary optic holder 40 is mounted on the printed circuit board 30 and includes a series of through holes 42 that are each adapted to receive the corresponding LED 34. Each through hole 42 includes a tapered surface 44 that surrounds the corresponding LED 34. Additional details regarding the light source 22 and the primary optic holder 40 can be found in U.S. Patent Pub. No. US2012/0140463A1, which is hereby incorporated by reference in its entirety.

The light source 22 further includes collimating optics in the form of twelve collimator packs 52 ultrasonically welded to the primary optic holder 40. Each collimator pack 52 includes a back plate 54 and five collimator lenses 56 protruding from the back plate 54 toward the primary optic holder 40. Each collimator lens 56 is positioned in a corresponding through hole 42 of the primary optic holder 40 and includes a parabolic surface that functions to reflect light from the corresponding LED 34 into the mixing assembly 24 by total internal reflection. The surface of the collimator lens 56 is slightly spaced from the tapered surface 44 of the primary optic holder 40. Each collimator lens 56 includes a cylindrical recess 60 that receives the corresponding LED 34. Alternatively, the collimator packs 52 could be formed as a single piece molded glass optic.

As explained in greater detail below, the LED light fixture 10 is configured to produce a color mix that unexpectedly produces a light mix with improved performance using a lower number of emitter types and channels.

As used herein, the following colors of LEDs are deemed to produce the dominant wavelengths listed in Table 1 below.

TABLE 1

| | Dominant Wavelength, nm | |
|---|---|---|
| Color | Minimum | Maximum |
| Deep Red | 651 | 675 |
| Red | 621 | 650 |
| Red-Orange | 610 | 620 |
| Green | 506 | 540 |
| Cyan | 491 | 505 |
| Blue | 451 | 490 |
| Indigo | 420 | 450 |

Unless otherwise indicated, a conventional LED is categorized by the range in which the dominant wavelength falls into and may be selected from, for example, a Luxeon LED in the C Color Line, Rebel Color Line, or Z Color Line (e.g., P/N L1C1-RED1000000000 (629 $\lambda_P$, FWHM=20 nm) and P/N L1C1-LME1000000000 (556 $\lambda_P$, FWHM=80 nm)). As used herein, the standard metric, excitation purity, is calculated using the standard illuminant D65, with x=0.3127, y=0.3291, as the reference point.

Figure 3:
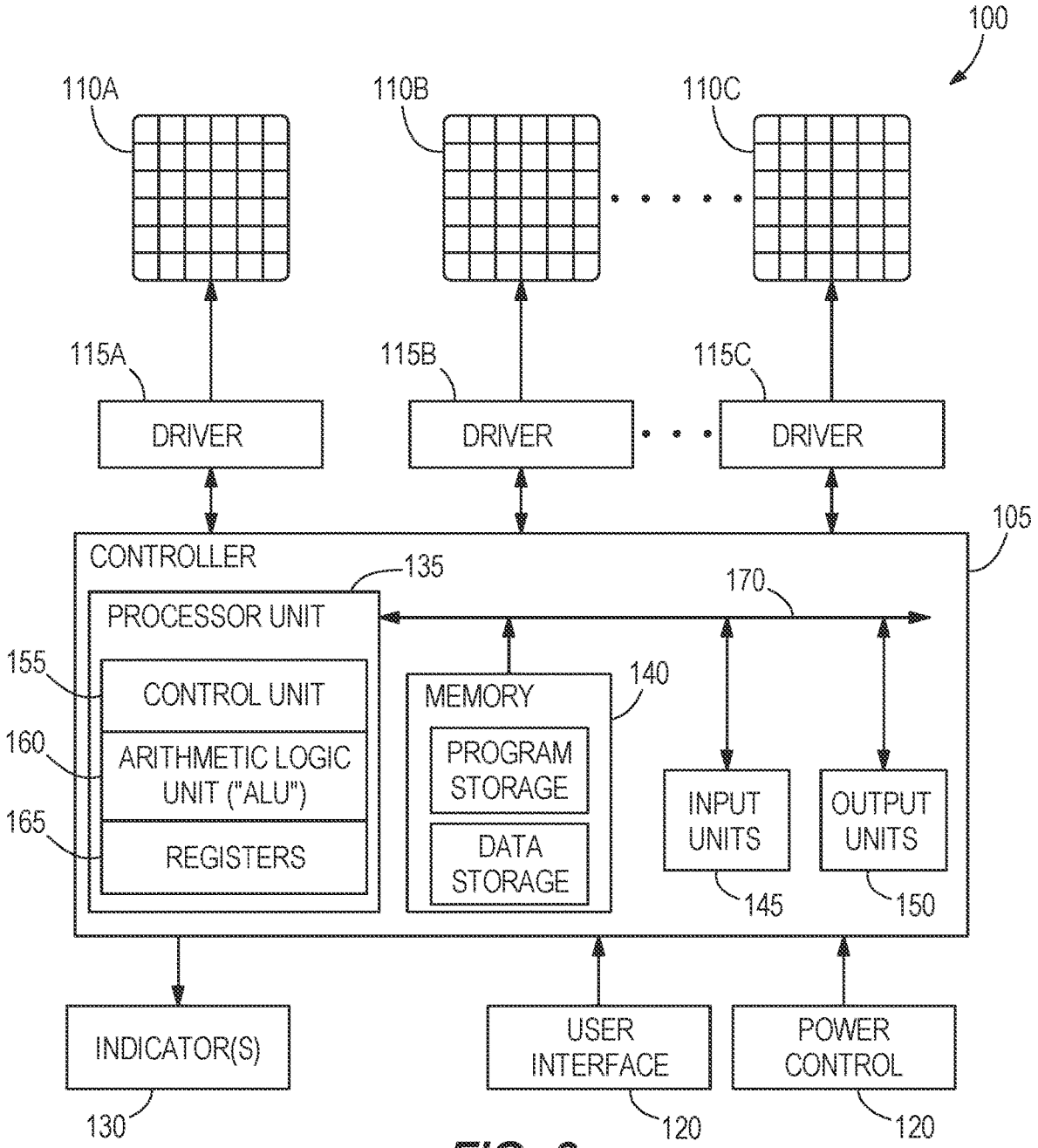
FIG. 3 is a block diagram of a lighting control system.

With reference to FIG. 3, a control system 100 that can be used in, for example, a theatre, a hall, an auditorium, a hotel, a cruise ship, or the like. In some embodiments, the control system 100 is disposed within a light fixture. In other embodiments, only a portion of the control system 100 is disposed in the light fixture. The control system 100 is configured to generate a light output according to specifications of a user. The control system 100 includes a controller 105, a plurality of light channels or light arrays 110A-110C, a plurality of driver circuits 115A-115C, a power control circuit 120, an input mechanism 125, and one or more indicators 130. The controller 105 includes a plurality of electrical and electronic components that provide power, operational control, and protection to the components and modules within the controller 105 and/or the system 100. For example, the controller 105 includes, among other things, a processing unit 135 (e.g., a microprocessor, a microcontroller, an electronic controller, an electronic processor, or another suitable programmable device), a memory 140, input units 145, and output units 150. The processing unit 135 includes, among other things, a control unit 155, an arithmetic logic unit ("ALU") 160, and a plurality of registers 165 (shown as a group of registers in FIG. 1), and is implemented using a known computer architecture (e.g., a modified Harvard architecture, a von Neumann architecture, etc.). The processing unit 135, the memory 140, the input units 145, and the output units 150, as well as the various modules connected to the controller 105 are connected by one or more control and/or data buses (e.g., common bus 170). The use of one or more control and/or data buses for the interconnection between and communication among the various modules and components would be known to a person skilled in the art in view of the embodiments described herein. The control and/or data buses are shown generally for illustrative purposes.

With continued reference to FIG. 3, the memory 140 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 135 is connected to the memory 140 and executes software instructions that are capable of being stored in a RAM of the memory 140 (e.g., during execution), a ROM of the memory 140 (e.g., on a generally permanent basis), or another non-transitory computer readable medium such as another memory or a disc. Software included in the implementation of the control system 100 can be stored in the memory 140 of the controller 105. The software includes, for example, firmware, one or more applications, program data, filters, rules, one or more program modules, and other executable instructions. The controller 105 is configured to retrieve from the memory 140 and execute, among other things, instructions related to the control processes and methods described herein. In other embodiments, the controller 105 includes additional, fewer, or different components.

The user interface 125 is included to control the control system 100. The user interface 125 is operably coupled to the controller 105 to control, for example, the output of the light arrays 110A-110C, and generate and provide control signals for the driver circuits 115A-115C. The user interface 125 can include any combination of digital and analog input devices to achieve a desired level of control for the control system 100. For example, the user interface 125 can include a computer having a display and input devices, a touch-screen display, a plurality of knobs, dials, switches, buttons, faders, or the like. In some embodiment, the user interface 125 is separated from the control system 100 (e.g., as a portable device communicatively connected to the controller 105).

The driver circuits 115A-115C include a first driver circuit 115A, a second driver circuit 115B, and a third driver circuit 115C that are operable to provide control signals to the light arrays 110A-110C. For example, the first driver circuit 115A is connected to a first light array 110A for providing a drive signal (i.e., an excitation current) to the first light array 110A (i.e., a first LED control channel). The second driver circuit 115B is connected to a second light array 110B for providing a drive signal to the second light array 110B (i.e., a second LED control channel). The third driver circuit 115C is connected to a third light array 110C for providing a drive signal to the third light array 110C (i.e., a third LED control channel). In the illustrated embodiment, there are three LED control channels shown. In other embodiments, less than three LED channels may be used in a light fixture. In other embodiments, more than three LED channels may be used in a light fixture. As described, a LED channel has one or more LEDs that are connected such that they operate together (i.e., they are on the same electrical output and receive the same excitation current from the driver).

The power control circuit 120 supplies a nominal AC or DC voltage to the control system 100. In some embodiments, the power control circuit 120 is powered by one or more batteries or battery packs. In other embodiments, the power control circuit 120 is powered by mains power having nominal line voltages between, for example, 100 V and 240 V AC and frequencies of approximately 50-60 Hz. The power control circuit 120 is also configured to supply lower voltages to operate circuits and components within the control system 100.

The controller 105 is connected to light arrays 110A-110C. In some embodiments, the light arrays 110A-110C are arranged as the LEDs 34 are shown in FIG. 2 as a chip-on-board ("COB") light source 22. A three light array embodiment is illustrated for exemplary purposes only. In other embodiments, four or more light arrays are used to further enhance the ability for the control system to produce visible light. Conversely, in other implementations, fewer than three light arrays are used (i.e., one or two light modules). In some embodiments, the light arrays 110A-110C are light emitting diode ("LED") light arrays.

Various custom LEDs are described herein for use alone or in combination with other LEDs in a light fixture.

Figure 4:
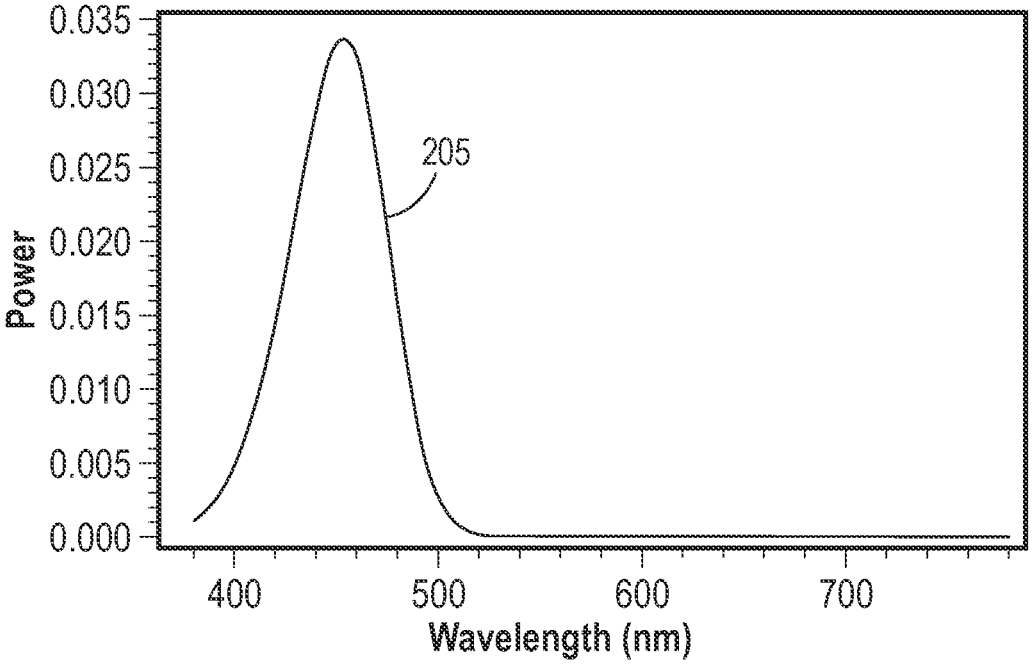
FIG. 4 is a spectral power distribution of a custom blue LED in the broad blue and indigo wavelength range.

With reference to FIG. 4, a spectral power distribution 205 is illustrated for a custom blue LED that emits a broad blue/indigo light (referred to herein as "custom blue LED"). In some embodiments, the custom blue LED is any one of the LEDs 34 in the light fixture 20. The custom blue LED includes the following characteristics listed in Table 1. In some embodiments, the spectral power distribution 205 of the custom blue LED is a skewed normal distribution with a center at approximately 471 nanometers, a spread of approximately 33 nanometers, and a skew of approximately −1.6.

TABLE 1

| Custom Blue LED | |
|---|---|
| Dominant wavelength ($\lambda_D$) | 460 nm |
| Peak wavelength ($\lambda_P$) | 453 nm |
| Full width at half maximum (FWHM) | 57 nm |
| Excitation purity ($p_e$) | 98% |
| CIE 1931 chromaticity (x, y) | (0.1473, 0.0367) |
| Luminous Efficacy of Radiation (LER) | 39 lumens/Watt |
| Skewed Normal Distribution {μ, σ, α} | {471, 33, −1.6} |

Figure 5:
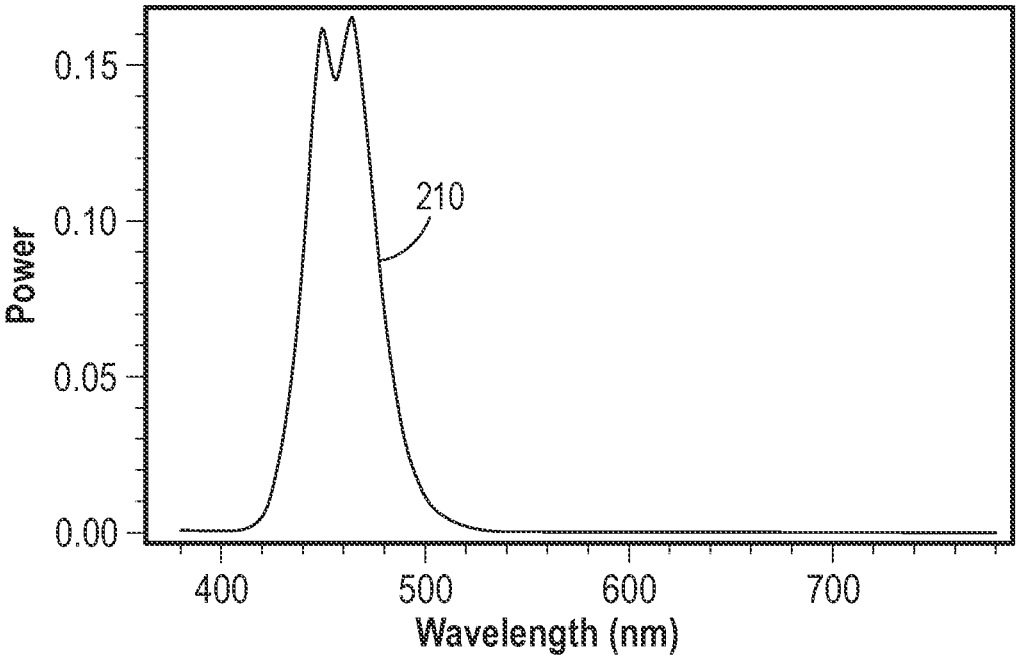
FIG. 5 is a spectral power distribution for a custom blue and indigo hybrid LED.

With reference to FIG. 5, a spectral power distribution 210 is illustrated for a custom blue and indigo hybrid LED (referred to herein as "custom blue and indigo hybrid LED"). In some embodiments, the custom blue and indigo hybrid LED is any one of the LEDs 34 in the light fixture 20. Specifically, the custom blue and indigo hybrid LED includes a blue LED and an indigo LED electrically coupled together (i.e., in the same LED control channel). In other words, the custom blue and indigo hybrid LED combines a blue emitter and an indigo emitter on a single LED string, such that they share a driver and control channel—therefore having the same current and PWM. The blue LED and the indigo LED are hardwired together such that they cannot be independently controlled (i.e., the receive the same excitation current). In some embodiments, the method of control for the blue and indigo hybrid LED compensates for differences between the two emitters, such as flux response with current, variation in peak wavelength or other color qualities of the individual emitters, thermal response, emitter deprecation or changes over time. The spectral power distribution 210 for the custom blue and indigo hybrid LED includes the following characteristics listed in Table 2. As illustrated in Tables 1 and 2, the custom blue LED and the custom blue and indigo hybrid LED have a peak wavelength within a range of approximately 450 nm and approximately 470 nm, and a full width at half maximum value within a range of approximately 40 nanometers and approximately 60 nanometers. Also, the custom blue LED and the custom blue and indigo hybrid LED have a dominant wavelength within a range of approximately 450 nanometers and approximately 472 nanometers, and an excitation purity between approximately 95% and 100%

TABLE 2

| Custom Blue and Indigo Hybrid LED | |
|---|---|
| Dominant wavelength ($\lambda_D$) | 464 nm |
| Peak wavelength ($\lambda_P$) | 464 nm |
| Full width at half maximum (FWHM) | 40 nm |
| Excitation purity ($p_e$) | 97% |
| CIE 1931 chromaticity (x, y) | (0.1429, 0.0465) |
| Luminous Efficacy of Radiation (LER) | 55 lumens/Watt |

The custom blue LED and the custom blue and indigo hybrid LED have advantages over conventional blue LEDS. A major source of color mixing error in conventional light fixtures is the chromaticity shift in different bins of blue LEDs. The custom blue LED and the custom blue and indigo hybrid LED improves rendering, especially for high-CCT whites. In addition, the custom blue LED and the custom blue and indigo hybrid LED can approximate the CIE $\bar{z}$ observer function.

Figure 6:
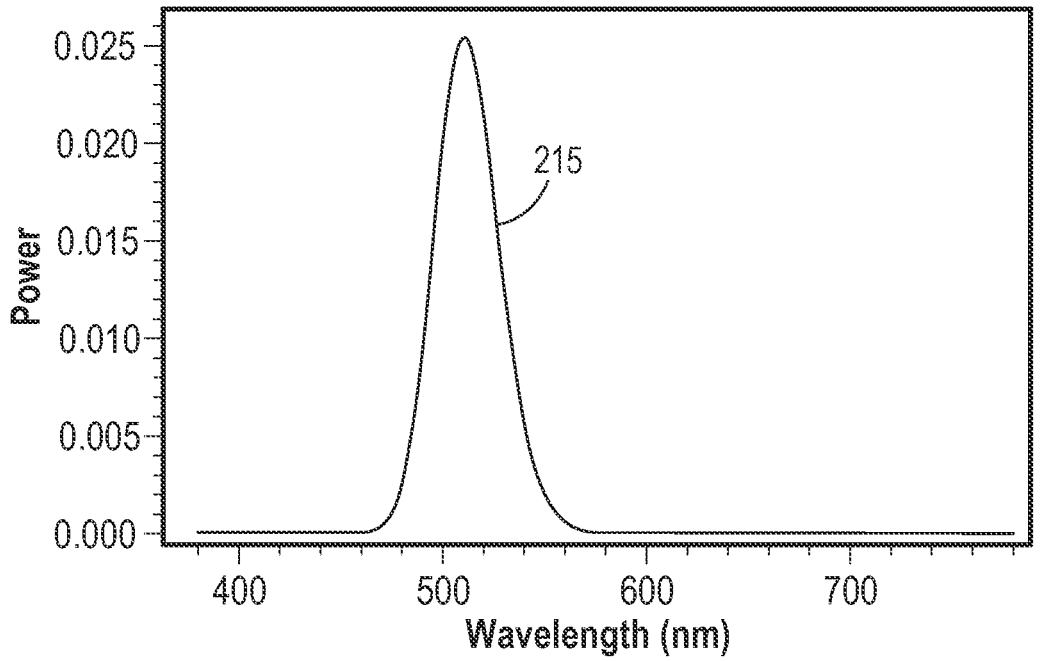
FIG. 6 is a spectral power distribution for a custom green LED in the narrow green and cyan wavelength range.

With reference to FIG. 6, a spectral power distribution 215 is illustrated for a custom green LED that emits a narrow green/cyan light (referred to herein as "custom green LED"). In some embodiments, the custom green LED is any one of the LEDs 34 in the light fixture 20. The custom green LED includes the following characteristics listed in Table 3, which includes two alternative embodiments of the custom green LED, both of which include approximately the same spectral power distribution 215. As illustrated in Table 3, the custom green LED peak wavelength within a range of approximately 510 nanometers and approximately 520 nanometers and a full width at half maximum value within a range of approximately 30 nanometers and 40 nanometers. Also, the custom green LED has a dominant wavelength within a range of approximately 510 nanometers and approximately 520 nanometers, and an excitation purity within a range of approximately 75% and 90%. In some embodiments, the spectral power distribution 215 of the custom green LED is represented as a skewed normal distribution with a center at approximately 499 nanometers, a spread of approximately 21 nanometers, and a skew value of approximately +1.4.

TABLE 3

| Custom Green LED, Example 1 | |
|---|---|
| Dominant wavelength ($\lambda_D$) | 512 nm |
| Peak wavelength ($\lambda_P$) | 510 nm |
| Full width at half maximum (FWHM) | 38 nm |
| Excitation purity ($p_e$) | 77% |
| CIE 1931 chromaticity (x, y) | (0.0897, 0.6973) |
| Luminous Efficacy of Radiation (LER) | 379 lumens/Watt |
| Skewed Normal Distribution {μ, σ, α} | {499, 21, +1.4} |
| **Custom Green LED, Example 2** | |
| Dominant wavelength ($\lambda_D$) | 516 nm |
| Peak wavelength ($\lambda_P$) | 512 nm |
| Full width at half maximum (FWHM) | 38 nm |
| Excitation purity ($p_e$) | 77% |
| CIE 1931 chromaticity (x, y) | (0.1081, 0.7067) |
| Luminous Efficacy of Radiation (LER) | 411 lumens/Watt |

The custom green LED has advantages over conventional green LEDs. The custom green LED can combine with a conventional lime LED in a light fixture to create a less-saturated green. In addition, the custom green LED may combine with the custom blue or custom blue and indigo hybrid LED to create certain desirable blue filter colors (e.g., a well-known blue gel filter color). Also, the custom green LED improves the performance of a light fixture in the ability to reach P1 design status under Annex E of TM-30-18, as explained in further detail below.

Figure 7:
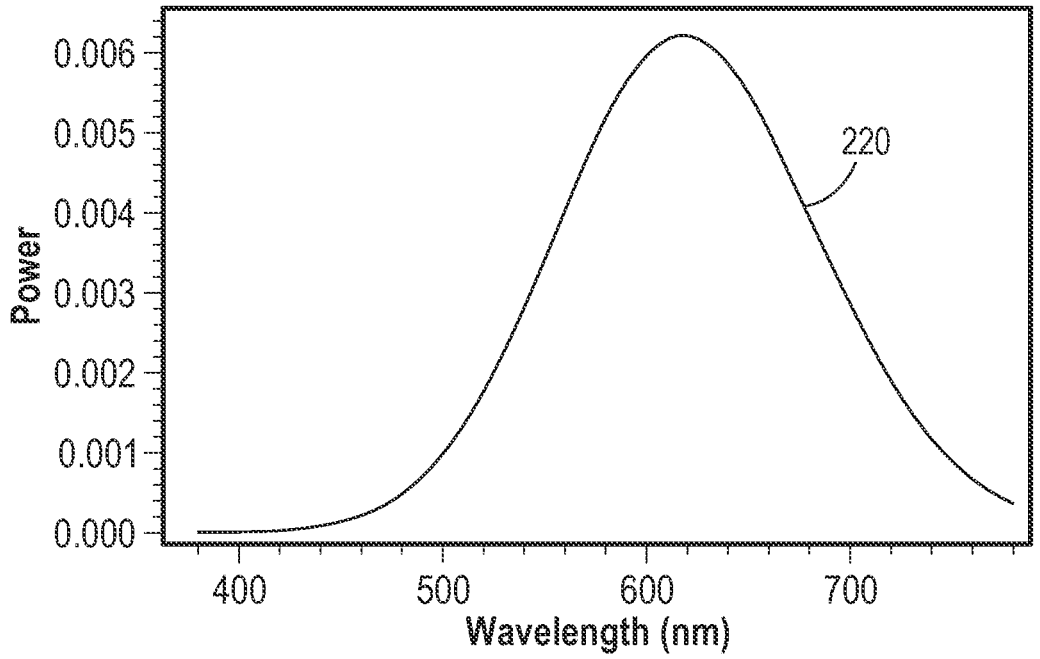
FIG. 7 is a spectral power distribution for a custom yellow LED in the broad yellow wavelength range.

With reference to FIG. 7, a spectral power distribution 220 is illustrated for a custom yellow LED that emits a broad yellow light (referred to herein as "custom yellow LED"). In some embodiments, the custom yellow LED is any one of the LEDs 34 in the light fixture 20. The custom yellow LED includes the following characteristics listed in Table 4, which includes two alternative embodiments of the custom yellow LED, both of which include approximately the same spectral power distribution 220. As illustrated in Table 4, the custom yellow LED has a peak wavelength within a range of approximately 600 nanometers and approximately 630 nanometers, and a full width at half maximum value of at least approximately 140 nanometers. Also, the custom yellow LED has a dominant wavelength within a range of approximately 580 nanometers and 600 nanometers. In some embodiments, the spectral power distribution 220 of the custom yellow LED is represented as a skewed normal distribution with a center at approximately 578 nanometers, a spread of approximately 78 nanometers, and a skew of approximately +1.0. The custom yellow has a luminous efficacy of radiation of at least 240 lumens/watt. In some embodiments, the custom yellow has a $R_f$ greater than 95 for a LER of approximately 320 lumens/Watt. The custom yellow has an excitation purity within a range of approximately 89% to approximately 93%.

TABLE 4

| Custom Yellow LED, Example 1 | |
|---|---|
| Dominant wavelength ($\lambda_D$) | 584 nm |
| Peak wavelength ($\lambda_P$) | 617 nm |
| Full width at half maximum (FWHM) | 151 nm |
| Excitation purity ($p_e$) | 92% |
| CIE 1931 chromaticity (x, y) | (0.5188, 0.4503) |
| Luminous Efficacy of Radiation (LER) | 283 lumens/Watt |
| Skewed Normal Distribution {μ, σ, α} | {578, 78, +1.0} |

TABLE 4-continued

| Custom Yellow LED, Example 2 | |
|---|---|
| Dominant wavelength ($\lambda_D$) | 585 nm |
| Peak wavelength ($\lambda_P$) | 621 nm |
| Full width at half maximum (FWHM) | 149 nm |
| Excitation purity ($p_e$) | 91% |
| CIE 1931 chromaticity (x, y) | (0.5205, 0.4453) |
| Luminous Efficacy of Radiation (LER) | 268 lumens/Watt |

In some embodiments, the custom yellow includes a CIE 1931 (x,y) chromaticity coordinate with an x-value within a range of approximately 0.4300 and approximately 0.5500 and a y-value within a range of approximately 0.4230 and approximately 0.477. In some embodiments, the custom yellow includes a CIE 1931 (x,y) chromaticity coordinate within an area defined by consecutively connected vertices: (0.5500, 0.4230), (0.5050, 0.4770), (0.4300, 0.4400), (0.4500, 0.4250), and (0.5000, 0.4400). In other words, the vertices are connected consecutively by straight lines to define a polygon with an area in the CIE 1931 color space, and the custom yellow includes a chromaticity coordinate within that area. The interior of this area is to the left as these vertices are traversed counterclockwise as viewed in the CIE 1931 color space. In other words, the custom yellow, in some embodiments, may have any CIE 1931 (x,y) chromaticity coordinate within the area defined by the vertices. In another embodiment, the CIE 1931 (x,y) chromaticity coordinate area for the custom yellow is bounded by a different range. For example, the CIE 1931 (x,y) chromaticity coordinate for the custom yellow may be within an area (i.e., a rectangle) defined by vertices: (0.5035, 0.4522), (0.5191, 0.4366), (0.5305, 0.4480), and (0.5149, 0.4636).

The custom yellow LED has advantages over conventional yellow LEDs and conventional amber LEDs. In particular, the custom yellow LED provides red content that is lacking in conventional amber LEDs. The spectral power distribution 220 of the custom yellow LED can further desaturate with some blue to fill spectral gaps between, for example, the custom blue LED and the custom green LED, which would make the emitter pastel/white.

Specifically, the spectral power distribution 220 of the custom yellow LED resembles a spectral power distribution 230 of a conventional white LED but without a prominent blue "pump." In order to be binned as a white, manufactures balance the pump (approximately 450 nm) emission with the broadly down-converted phosphor mission (>500 nm) to cause the chromaticity to fall on or very near to the Planckian locus. In contrast, the custom yellow LED pump is suppressed; causing its chromaticity to lie well away from the Planckian locus. When the custom yellow LED is employed in color-mixed arrays, such as those described herein, the custom yellow LED allows a user to choose to create a high-quality white light. The comparison of the fractional energy of various blueward pumps for conventional white LEDs at different temperatures and the custom yellow LED in Table 5.

TABLE 5

| | CCT | Spectral Energy of Blueward of 480 nm |
|---|---|---|
| Conventional White LED | 2200 K | 3.3% |
| | 2700 K | 5.4% |
| | 3000 K | 6.40% |
| | 3500 K | 8.60% |
| | 4000 K | 11.1% |
| Custom Yellow LED | | 1.3% |

Figure 7A:
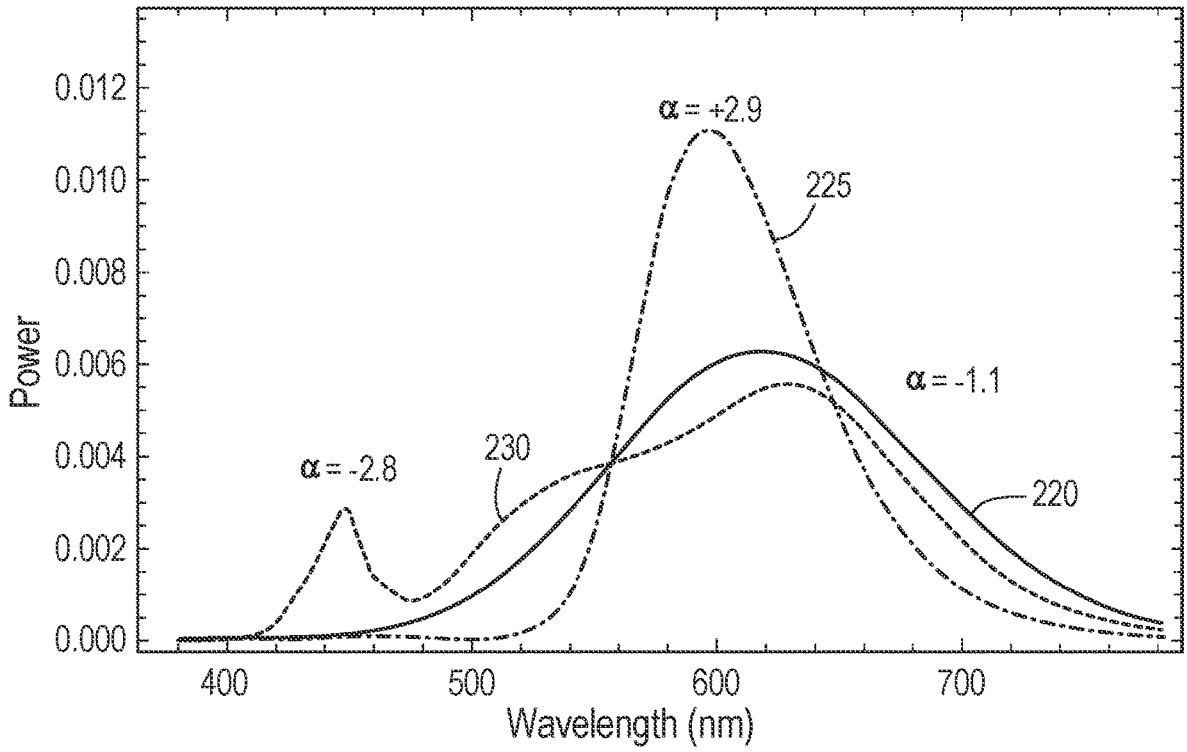
FIG. 7A is a comparison of spectral power distributions for the custom yellow LED of FIG. 7, a conventional white LED, and a conventional amber LED.

With reference to FIG. 7A, the spectral power distribution 220 of the custom yellow LED has a redward (i.e., mathematically rightward, or negative) skew when compared to a spectral power distribution 225 of a conventional amber LED, which has a blueward (i.e., mathematically leftward, or positive) skew. In other words, the spectral power distribution 220 is asymmetrical and skewed about a center wavelength toward longer wavelengths. In some embodiments, approximately half of the spectral energy of the custom yellow LED is greater than approximately 620 nm, which is the approximate peak wavelength of conventional red LEDs. Also, less than approximately 3% of the spectral energy of the custom yellow LED is less than approximately 480 nanometers. This redward energy is broadly emitted across a wide wavelength range and is not concentrated in a narrow area or truncated at or around 660 nm. This redward energy may be less efficient at stimulating the eye according to the photopic luminosity function but provides important rendering uses. In other words, the redward energy of the custom yellow LED is typically thought to be "wasted" light because it falls in a region of diminished human eye response. The industry trend is to narrow the red wavelengths and eliminate the "inefficiency" of long red wavelengths. However, in contrast to this conventional thinking, the redward energy of the custom yellow LED is important for the subjective quality of light perceived and its effects, for example, on the appearance of human skin, objects, and environment. As such, the custom yellow LED has a suppressed blue pump and broad red wavelength coverage. In further embodiments, the custom yellow LED may have a positive skew, but still retain a broad red wavelength coverage. In other words, in some embodiments the custom yellow LED may have a spectral power distribution that is represented as a skew normal distribution with a skew value within a range of approximately 1.0 and approximately −1.5.

Figure 8:
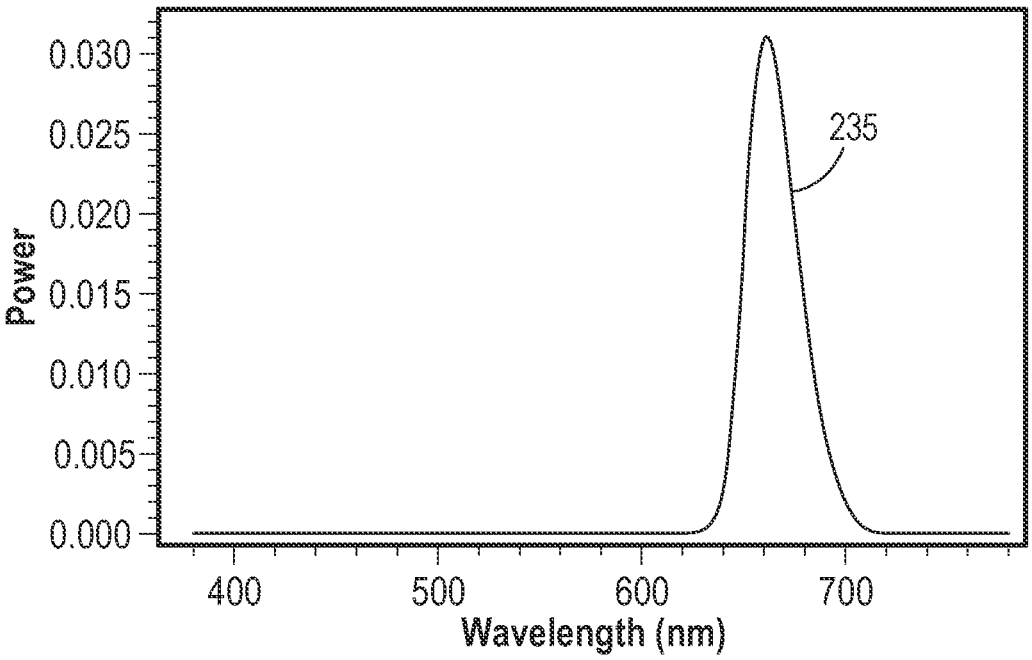
FIG. 8 is a spectral power distribution for a custom red LED according to a first embodiment, in the narrow deep red wavelength range.
Figure 9:
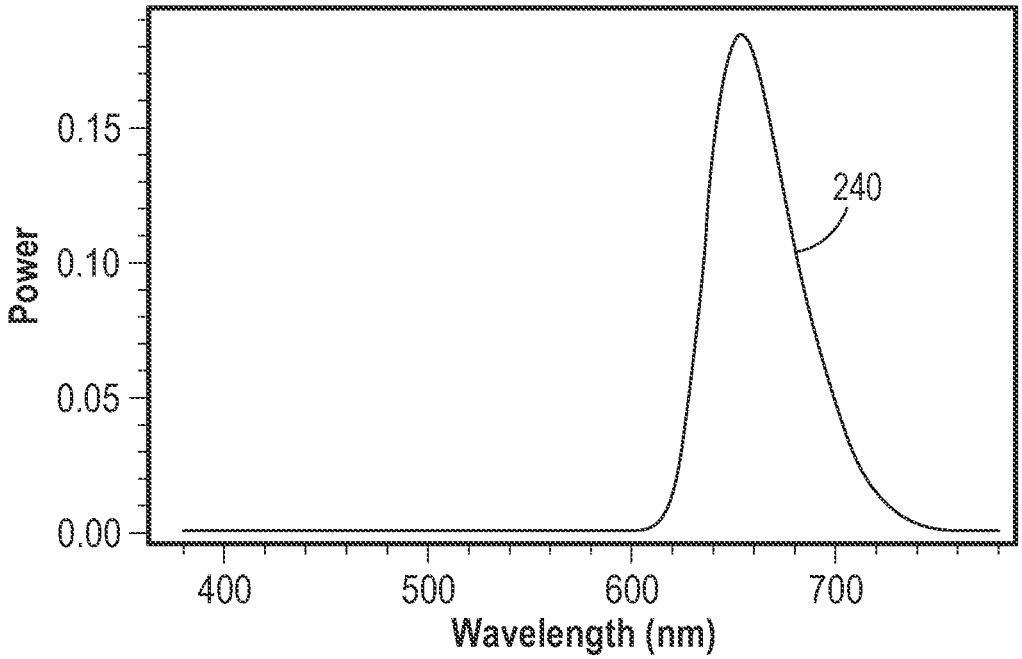
FIG. 9 is a spectral power distribution for a custom red LED according to a second embodiment, in the broad red wavelength range.
Figure 10:
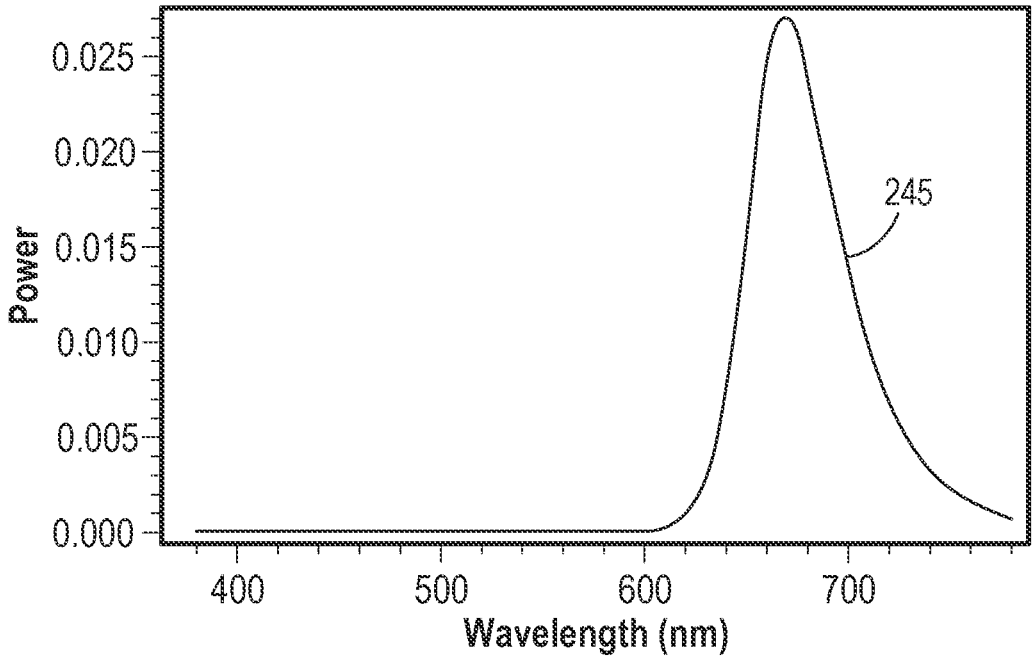
FIG. 10 is a spectral power distribution for a custom red LED according to a third embodiment.

With reference to FIG. 8, a spectral power distribution 235 is illustrated for a custom red LED according to a first embodiment that emits a red (referred to herein as "custom red LED"). With reference to FIG. 9, a spectral power distribution 240 is illustrated for a custom red LED according to a second embodiment that emits a red light (still referred to herein as "custom red LED"). With reference to FIG. 10, a spectral power distribution 245 is illustrated for a custom red LED according to a third embodiment that emits a red light (still referred to herein as "custom red LED"). In some embodiments, the custom red LED is any one of the LEDs 34 in a light fixture 20. The custom red LED includes the following characteristics listed in Table 6, which includes the three alternative embodiments of the custom red LED, each with their own spectral power distribution illustrated in FIGS. 8-10, respectively. As illustrated in Table 6, the custom red LED has a peak wavelength within a range of approximately 650 nanometers and approximately 670 nanometers, and a full width at half maximum value within a range of approximately 30 nanometers and approximately 55 nanometers. Also, the custom red LED has dominant wavelength within a range of approximately 640 nanometers and approximately 655 nanometers, and an excitation purity within a range of approximately 96% and 100%. In one embodiment, the spectral power distribution for the custom red LED is represented as a skewed normal distribution with a center at approximately 651 nanometers, a spread of approximately 20 nanometers, and a skew of approximately +2.4. In a second embodiment, the spectral power distribution for the custom red LED is represented as a skewed normal distribution with a center of approximately 636 nanometers, a spread of approximately 36 nanometers, and a skew value of approximately +3.1. In a third embodiment, the spectral power distribution for the custom red LED is a skewed normal distribution with a center, spread, and skew value within a range between the previous two embodiments described.

TABLE 6

| Custom Red LED, Example 1 | |
|---|---|
| Dominant wavelength ($\lambda_D$) | 654 nm |
| Peak wavelength ($\lambda_P$) | 661 nm |
| Full width at half maximum (FWHM) | 30 nm |
| Excitation purity ($p_e$) | 100% |
| CIE 1931 chromaticity (x, y) | (0.7279, 02721) |
| Luminous Efficacy of Radiation (LER) | 38 lumens/Watt |
| Skewed Normal Distribution {μ, σ, α} | {651, 20, +2.4} |
| **Custom Red LED, Example 2** | |
| Dominant wavelength ($\lambda_D$) | 640 nm |
| Peak wavelength ($\lambda_P$) | 653 nm |
| Full width at half maximum (FWHM) | 51 nm |
| Excitation purity ($p_e$) | 100% |
| CIE 1931 chromaticity (x, y) | (0.7186, 0.2813) |
| Luminous Efficacy of Radiation (LER) | 59 lumens/Watt |
| Skewed Normal Distribution {μ, σ, α} | {636, 36, +3.1} |
| **Custom Red LED, Example 3** | |
| Dominant wavelength ($\lambda_D$) | 649 nm |
| Peak wavelength ($\lambda_P$) | 669 nm |

TABLE 6-continued

| | |
|---|---|
| Full width at half maximum (FWHM) | 51 nm |
| Excitation purity ($p_e$) | 96% |
| CIE 1931 chromaticity (x, y) | (0.7103, 0.2762) |
| Luminous Efficacy of Radiation (LER) | 30 lumens/Watt |

The custom red LED has advantages over conventional red LEDs. For example, the custom red LED according to the first embodiment approximates the chromaticity of far red (740 nm) while not sacrificing brightness, thereby deepening the gamut. The custom red LED accomplishes this by removing the amberward portion of the deep red spectrum ("deep red" is approximately $\lambda_D$=640 nm, $\lambda_P$=661 nm, FWHM=21 nm). Also, the custom red LED according to the second embodiment combines the functionality of red and deep red by adding a broad range of long wavelengths that are typically missing from conventional LED light sources. As such, the custom red LED is able to restore rendition nuances that were possible with halogen, incandescent, and daylight sources. The custom red LED accomplishes this while still utilizing a single control channel and without mixing chip types on a single string. The custom red LED according to the third embodiment represents a combination of the custom red LED according to the first and second embodiments.

The above described custom LEDs have unique characteristics as stand-alone LEDS, but also create unique characteristics and properties when combined into a custom LED light array. Custom light arrays with varying numbers of LED control channels are described herein. Any one of the custom light arrays described herein may be integrated with the light fixture 20, the LEDs 34 and/or the light arrays 110A-110C.

Figure 11A:
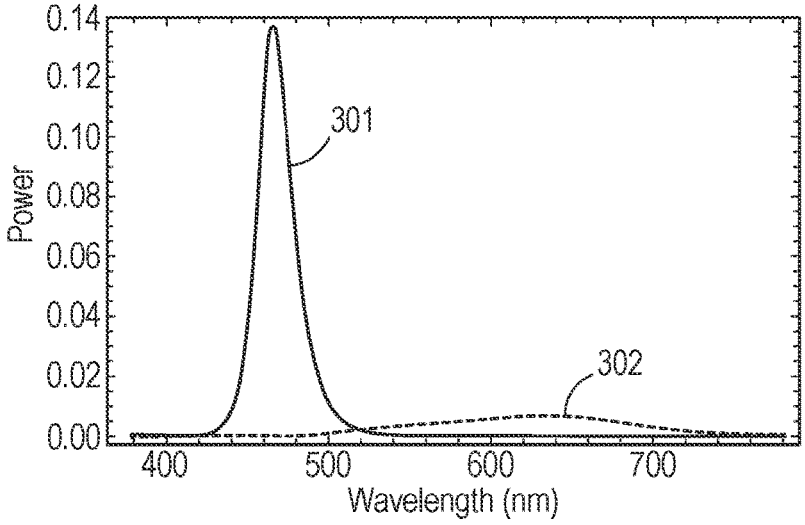
FIG. 11A illustrates emitter spectra of a two-channel array.
Figure 11B:
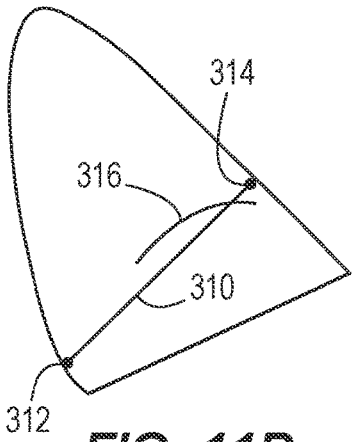
FIG. 11B is the CIE 1931 color space illustrating a color gamut of the two-channel array of FIG. 11A.
Figure 11C:
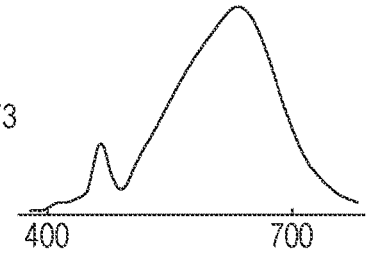
FIG. 11C illustrates the performance of the two-channel array of FIG. 11A.

With reference to FIGS. 11A-11C, a first custom light array with two LED channels is configured to produce a candle color white (a "candle color array"). In the illustrated embodiment, the candle color array includes six custom yellow LEDs and one blue LED for a total of seven LEDs with the color mix shown in Table 7. In some embodiments, the blue LED in the candle color array is either the custom blue LED or the custom blue and indigo hybrid LED. It should be understood, the LED count is not limiting, and other embodiments exist with different LED counts. As shown in Table 7, a total flux from the six custom yellow LEDs combined is approximately 95.6% of a total lumen output for the candle color array. In other embodiments, the total flux from the custom yellow LEDs combined is within a range of approximately 93% to approximately 99% of the total lumen output.

TABLE 7

| Candle Color Array | | | | | | | |
|---|---|---|---|---|---|---|---|
| | | Per LED | | Per Channel | | | |
| Channel | LED Count | Optical Power (W) | Luminous Flux (lm) | Optical Power (W) | Luminous Flux (lm) | Power Ratio | Flux Ratio |
| Custom Yellow | 6 | 1 | 289 | 6 | 1734 | 88.6% | 95.6% |
| Blue | 1 | 0.77 | 80 | 0.77 | 80 | 11.4% | 4.4% |
| Total | 7 | | | 6.77 | 1814 | 100% | 100% |

With reference to FIG. 11A, the spectral power distribution for candle color array is illustrated with the spectral power distribution 301 for the blue LED and the spectral power distribution 302 for the custom yellow LEDs. In other words, FIG. 11A represents the emitter spectra according to one embodiment of the candle color array. With reference to FIG. 11B, a corresponding color gamut 310 is achievable by the candle color array. Specifically, the gamut 310 is illustrated in the CIE 1931 color space and connects the x,y coordinates 312 for the blue LED and the x,y coordinate 314 for the custom yellow LED. As illustrated, the color gamut 310 of the candle color array intersects the Planckian locus 316).

With reference to FIG. 11C, the rendering performance of the candle color array is illustrated for a relevant white color. Specifically, FIG. 11C illustrates the rendering performance of the candle color array for a white colored light at 2450 K that results in the corresponding output spectral power distribution shown ("output SPD"). Performance of the candle color array is represented in FIG. 11C with various metrics that are introduced and described herein.

Correlated Color Temperature (CCT) defines the color appearance of a white LED. CCT is defined using the Kelvin scale with a "warm" white light around 2700 K and "cool" white light around 5000 K.

$R_f$ is a fidelity index, which indicates how similar the rendering is to a reference illuminant. The max value for $R_f$ is 100. $R_f$ is determined using a well-defined process such as is described in IES TM-30-18 published by the Illuminating Engineering Society (IES), and evaluates the fidelity of a light source when compared to a reference.

$R_g$ is the gamut index, which essentially indicates an average chroma shift, or saturation change, relative to the reference. $R_g$ is determined using a well-defined process such as is described in IES TM-30-18. A $R_g$ value of less than 100 is undersaturated or muted, whereas a $R_g$ value of greater than 100 is oversaturated or vivid. Also, $R_g$ takes hue shift into account.

$R_{cs,h1}$ indicates a chroma-shift (saturation change) measure for color samples in hue bin 1, which includes objects with red appearance. $R_{cs,h1}$ can be a useful contributing indicator when skin rendition is important. For example, if $R_{cs,h1}$ is too low, in conjunction with $R_f$ and/or $R_g$ it may indicate the illuminant may make skin appear sallow or pale. In contrast, if the $R_{cs,h1}$ is too high, in conjunction with $R_f$ and/or $R_g$ it may indicate the illuminant may make skin appear flushed or overly red. Primarily, hue bin 1 is key because experimental data has shown red rendition to be an important indicator for humans. Research suggests typical observers aesthetically prefer a slight boost in reds and notice when red is missing.

$R_{f,h1}$ indicates fidelity for color samples in hue bin 1.

The Annex E provides design guidance on what purposes the illuminant is likely to be suited for. Annex E is an annex to the ANSI/IES TM-30-18 standard. Annex E includes three design intent categories: preference (P), vividness (V), and fidelity (F), and scoring within those categories range from priority level 1 (highest) to priority level 3 (lowest). High levels of priority increase the likelihood of achieving the given design intent, whereas lower levels offer increased flexibility to account for other considerations.

The 4 measures listed ($R_f$, $R_g$, $R_{cs,h1}$, $R_{f,h1}$) are used in Annex E to calculate suitability for a given design intent category. Specifically, hue bin 1 is crucial in the Annex E design criteria. $R_{cs,h1}$ values are required to determine all three priority levels for both preference and vividness. $R_{f,h1}$ values are required to determine fidelity priorities F2 and F3. In applications where skin rendition is important, preference and/or fidelity are likely to be high priorities.

The Color Rendering Index $R_a$ (CRI) provides a representation of an artificial light's accuracy of rendering a sample set of colored objects in comparison to a reference source. A perfect CRI score is 100, which indicates that the artificial light source renders the color sample set the same as the reference source.

R9 is a supplemental score to the CRI value that judges a light sources' color rendering ability, specifically as it concerns red-hued objects.

The Television Light Consistency Index (TLCI) is used in order to predict a light's ability to accurately render color when captured by a television camera and viewed on a display and was created by the European Broadcasting Union (EBU). The TLCI is based on a mathematical calculation implemented in software called TLCI-2012, which is specified in EBU Tech 3355. Like the CRI value, the TLCI value has a maximum of 100. In general, when recording on a camera in a studio setting, a higher TLCI is considered desirable.

The candle color array has advantages as a custom two channel LED light array. The custom yellow LED paired with the blue LED (or the custom blue LED or the custom blue and indigo hybrid LED) creates a low-CCT (approximately 2400 K), high-rendering (CRI approximately equal to or greater than 90) white. Conventional low-CCT whites typically have lower rendering quality. The candle color array permits in-house calibration by balancing the flux from the two emitters to ensure a chromaticity on the Planckian locus 316.

Figure 12A:
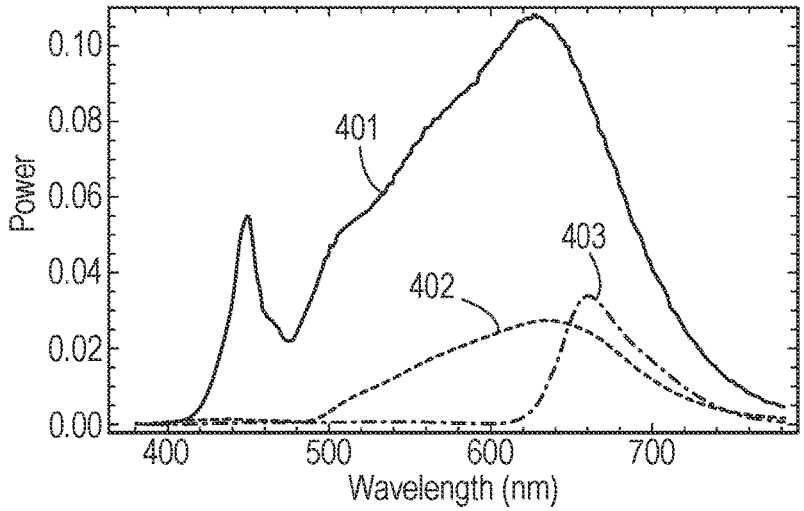
FIG. 12A illustrates emitter spectra of a three-channel array.
Figure 12B:
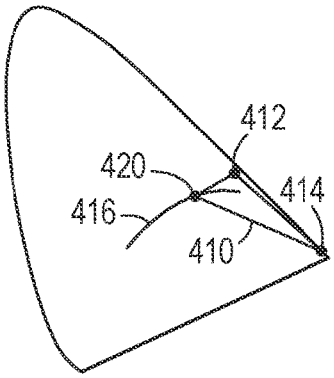
FIG. 12B is the CIE 1931 color space illustrating a color gamut of the three-channel array of FIG. 12A.
Figure 12C:
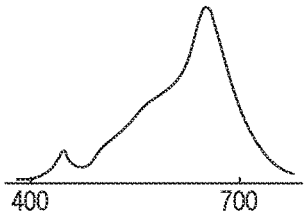
FIG. 12C illustrates the performance of the three-channel array of FIG. 12A.
Figure 12C:
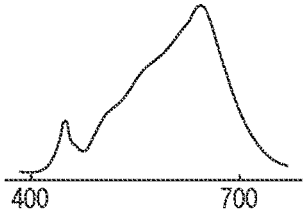
Figure 12C:
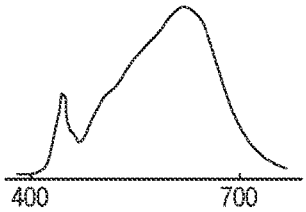

With reference to FIGS. 12A-12C, a second custom light array with three LED channels is configured to produce a fade-to-warm array (a "fade-to-warm array"). In the illustrated embodiment, the fade-to-warm array includes four custom red LEDs, four custom yellow LEDs, and 16 white LEDs for a total of 24 LEDs with the color mix shown in Table 8. In some embodiments, the custom red LED in the fade-to-warm array is the custom red LED according to the first embodiment of FIG. 8, the second embodiment of FIG. 9 or the third embodiment of FIG. 10. As shown in Table 8, a total flux from the four custom yellow LEDs combined is approximately 17.1% of a total lumen output for the fade-to-warm array. In other embodiments, the total flux from the custom yellow LEDs combined is within a range of approximately 10% to approximately 24% of the total lumen output. Likewise, a total flux from the four custom red LEDs combined is approximately 1.3% of a total lumen output for the fade-two-warm array. In other embodiments, the total flux from the custom red LEDs combined is within a range of approximately 1% to approximately 2% of the total lumen output.

TABLE 8

| Fade-to-Warm Array | | | | | | | |
|---|---|---|---|---|---|---|---|
| | | Per LED | | Per Channel | | | |
| Channel | LED Count | Optical Power (W) | Luminous Flux (lm) | Optical Power (W) | Luminous Flux (lm) | Power Ratio | Flux Ratio |
| Custom Red | 4 | 0.55 | 22 | 2.2 | 88 | 8.7% | 1.3% |
| Custom Yellow | 4 | 1 | 289 | 4 | 1156 | 15.7% | 17.1% |
| White | 16 | 1.2 | 344 | 19.2 | 5504 | 75.6% | 81.6% |
| Total | 24 | | | 25.4 | 6748 | 100% | 100% |

With reference to FIG. 12A, the spectral power distribution for the fade-to-warm array is illustrated with the spectral power distribution 401 for the conventional white LED, the spectral power distribution 402 for the custom yellow LED, and the spectral power distribution 403 for the custom red LED. In other words, FIG. 12A represents the emitter spectra according to one embodiment of the fade-to-warm array. With reference to FIG. 12B, a corresponding color gamut 410 is achievable by the fade-to-warm array. Specifically, the gamut 410 is illustrated in the CIE 1931 color space and connects the x,y coordinates 412 for the custom yellow LED, the x,y coordinate 414 for the custom red LED, and the x,y coordinate 420 for the white LED, which is on the Planckian locus 416. As illustrated, the color gamut 410 of the fade-to-warm array includes a portion of the Planckian locus 416 contained within the color gamut 410.

With reference to FIG. 12C, the rendering performance of the fade-to-warm array is illustrated for relevant white colors. Specifically, FIG. 12C illustrates the rendering performance of the fade-to-warm array for a white colored light at 2400 K, 2700 K, and 3000 K (along with the corresponding output SPD).

The fade-to-warm array has advantages as a custom three channel LED light array. The custom yellow LED and the custom red LED combine with a conventional white LED (e.g., a 3000 K white) to achieve high quality rendering as the color temperature is lowered and reaches Annex E design priority level 1 for preference (P1). For example, the fade-to-warm array creates a color mix with a CCT of 2400 K and an Annex E priority level 1 for preference (P1).

Figure 13A:
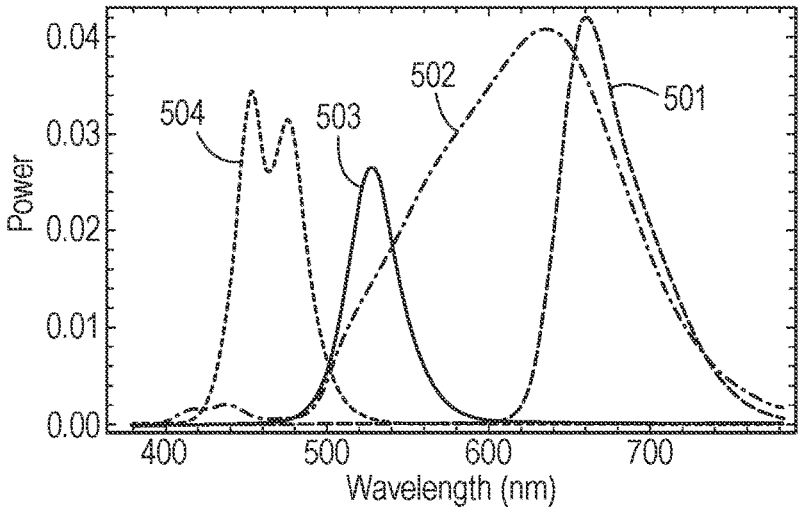
FIG. 13A illustrates emitter spectra of a four-channel array.
Figure 13B:
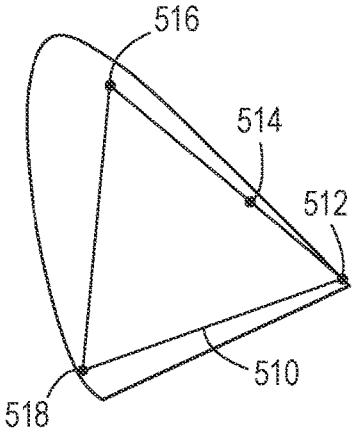
FIG. 13B is the CIE 1931 color space illustrating a color gamut of the four-channel array of FIG. 13A.
Figure 13C:
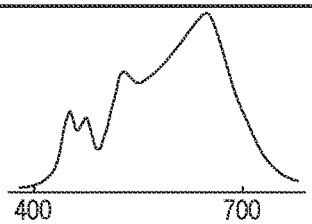
FIG. 13C illustrates the performance of the four-channel array of FIG. 13A.
Figure 13C:
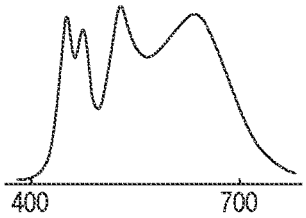
Figure 13C:
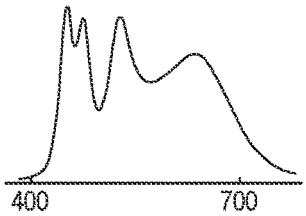

With reference to FIGS. 13A-13C, a third custom light array includes four LED control channels ("a four-channel array"). In the illustrated embodiment, the four-channel array includes five custom red LEDs, six custom yellow LEDs, three green LEDs, and one custom blue and indigo hybrid LED for a total of 15 LEDs with the color mix shown in Table 9. In some embodiments, the blue and indigo hybrid LED is replaced with the custom blue LED. In some embodiments, the custom red LED in the four-channel array is the custom red LED according to the first embodiment of FIG. 8, the second embodiment of FIG. 9 or the third embodiment of FIG. 10. As shown in Table 9, a total flux from the six custom yellow LEDs combined is approximately 68% of a total lumen output for the four-channel array. In other embodiments, the total flux from the custom yellow LEDs combined is within a range of approximately 64% to approximately 72% of the total lumen output. Likewise, the total flux from the five custom red LEDs combined is approximately 4.3% of a total lumen output for the four-channel array. In other embodiments, the total flux from the custom red LEDs combined is within a range of approximately 4% to approximately 6% of the total lumen output.

TABLE 9

| 4-Channel Array | | | | | | | |
|---|---|---|---|---|---|---|---|
| | | Per LED | | Per Channel | | | |
| Channel | LED Count | Optical Power (W) | Luminous Flux (lm) | Optical Power (W) | Luminous Flux (lm) | Power Ratio | Flux Ratio |
| Custom Red | 5 | 0.55 | 22 | 2.75 | 110 | 23.8% | 4.3% |
| Custom Yellow | 6 | 1 | 289 | 6 | 1734 | 51.9% | 68.0% |
| Green | 3 | 0.37 | 196 | 1.11 | 588 | 9.6% | 23.1% |
| Custom Blue and Indigo Hybrid LED | 1 | 1.7 | 118 | 1.7 | 118 | 14.7% | 4.6% |
| Total | 15 | | | 11.56 | 2550 | 100% | 100% |

With reference to FIG. 13A, the spectral power distribution for four-channel array is illustrated with the spectral power distribution 501 for the custom red LED, the spectral power distribution 502 for the custom yellow LED, the spectral power distribution 503 for the green LED, and the spectral power distribution 504 for the custom blue and indigo hybrid LED. In other words, FIG. 13A represents the emitter spectra according to one embodiment of the four-channel array. With reference to FIG. 13B, a corresponding color gamut 510 is achievable by the four-channel array. Specifically, the gamut 510 is illustrated in the CIE 1931 color space and connects the x,y coordinates 512 for the custom red LED, the x,y coordinate 514 for the custom yellow LED, the x,y coordinate 516 for the green LED, and the x,y coordinate 518 for the custom blue and indigo hybrid LED.

With reference to FIG. 13C, the rendering performance of the four-channel array is illustrated for relevant white colors. Specifically, FIG. 13C illustrates the rendering performance of the four-channel array for a white colored light at 3200 K, 4500 K, and 5600 K (along with the corresponding output SPD).

The four-channel array has advantages as a custom four channel light array. Conventional simple color-tunable arrays typically include emitters that are red, green and blue (RGB) and white (RGBW) or amber (RGBA) ("conventional short arrays"). Rendering performance is often poor with these conventional short arrays. Although, the addition of a white LED and an amber LED to create a RGBAW array improves rendering performance, it would have a total five control channels and drivers (one for each of red, blue, green, amber, and white) and would require use of sophisticated color-mixing algorithms. The custom yellow LED in the four-channel array offers the gamut benefits of an RGBA array and the rendering benefits of including an explicit white emitter in a simple four channel package. For example, the four-channel array emits a color mix with a CCT within a range of approximately 3200K to approximately 5600K while maintaining an Annex E priority level 1 for preference (P1). Of note, with reference to FIG. 13C, the third array achieves CRI and TM-30-18 $R_f$ values that are both greater than 90 and TM-30-18 Annex E's design priority level 1 for preference (P1) with the commonly used color temperatures (CCTs).

Additional comparisons of the four-channel array to conventional RGB and RGBAW arrays are illustrated in Table 10. The four-channel array has rendering benefits in white as well as in saturated colors. For example, the four-channel array is able create rich and highly nuanced revelation of color in objects or environments, whether for entertainment applications such as theatrical backdrops or scenery or for creating certain effects, moods, or revealing depth and variety in materials, such as in marble or granite, in architectural applications.

TABLE 10

| | 3200 K | | | | 5600 K | | | |
|---|---|---|---|---|---|---|---|---|
| | $R_f$ | $R_g$ | $R_{cs,h1}$ | Annex E | $R_f$ | $R_g$ | $R_{cs,h1}$ | Annex E |
| Conventional RGB | 48 | 103 | +34.7% | P—\|V3\| F— | 46 | 100 | +40.5% | P—\| V3\| F— |
| Conventional RGBAW | 93 | 99 | −1.5% | P1\|V—\| F2 | 77 | 88 | −1.9% | P—\| V—\| F— |
| The Four-Channel Array | 91 | 106 | +1.0% | P1\|V3\| F2 | 91 | 105 | +3.1% | P1\| V3\| F2 |

Figure 14A:
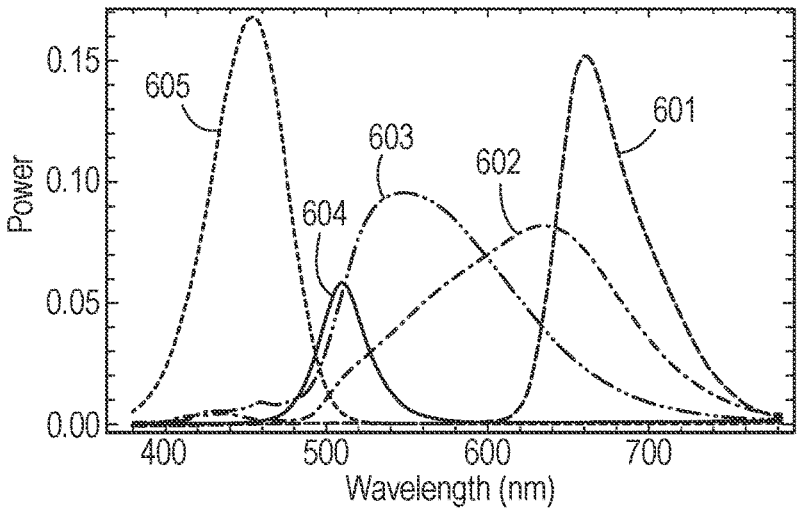
FIG. 14A illustrates emitter spectra of a five-channel array.
Figure 14B:
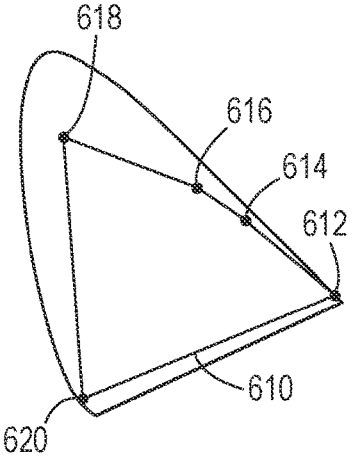
FIG. 14B is the CIE 1931 color space illustrating a color gamut of the five-channel array of FIG. 14A.
Figure 14C:
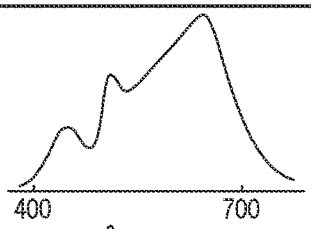
FIG. 14C illustrates the performance of the five-channel array of FIG. 14A.
Figure 14C:
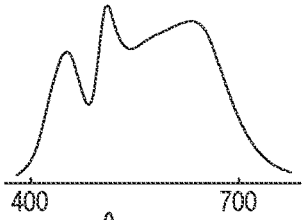
Figure 14C:
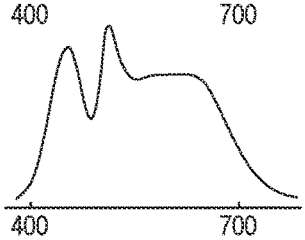

With reference to FIGS. 14A-14C, a fourth custom light array includes five LED channels ("a five-channel array"). In the illustrated embodiment, the five-channel array includes 18 custom red LEDs, 12 custom yellow LEDs, 15 lime LEDs, 6 cyan LEDs, and 9 custom blue LEDs for a total of 60 LEDs with the color mix shown in Table 11. In some embodiments, the custom blue LED is replaced with the custom blue and indigo hybrid LED. In some embodiments, the custom red LED in the five-channel array is the custom red LED according to the first embodiment of FIG. 8, the second embodiment of FIG. 9 or the third embodiment of FIG. 10. As shown in Table 11, a total flux from the twelve custom yellow LEDs combined is approximately 33.2% of a total lumen output for the five-channel array. In other embodiments, the total flux from the custom yellow LEDs combined is within a range of approximately 30% to approximately 36% of the total lumen output.

TABLE 11

| Five-Channel Array | | | | | | | |
|---|---|---|---|---|---|---|---|
| | | Per LED | | Per Channel | | | |
| Channel | LED Count | Optical Power (W) | Luminous Flux (lm) | Optical Power (W) | Luminous Flux (lm) | Power Ratio | Flux Ratio |
| Custom Red | 18 | 0.55 | 22 | 9.9 | 396 | 21.3% | 3.8% |
| Custom Yellow | 12 | 1 | 289 | 12 | 3468 | 25.9% | 33.2% |
| Lime | 15 | 0.82 | 357 | 12.3 | 5355 | 26.5% | 51.3% |
| Cyan | 6 | 0.38 | 139 | 2.28 | 834 | 4.9% | 8.0% |
| Custom Blue | 9 | 1.1 | 43 | 9.9 | 387 | 21.3% | 3.7% |
| Total | 60 | | | 46.38 | 10440 | 100% | 100% |

With reference to FIG. 14A, the spectral power distribution for the five-channel array is illustrated with the spectral power distribution 601 for the custom red LED, the spectral power distribution 602 for the custom yellow LED, the spectral power distribution 603 for the lime LED, the spectral power distribution 604 for the cyan LED, and the spectral power distribution 605 for the custom blue LED. In other words, FIG. 14A represents the emitter spectra according to one embodiment of the five-channel array. With reference to FIG. 14B, a corresponding color gamut 610 is achievable by the five-channel array. Specifically, the gamut 610 is illustrated in the CIE 1931 color space and connects the x,y coordinates 612 for the custom red LED, the x,y coordinate 614 for the custom yellow LED, the x,y coordinate 616 for the lime LED, the x,y coordinate 618 for the cyan LED, and the x,y coordinate 620 for the custom blue LED.

With reference to FIG. 14C, the rendering performance of the five-channel array is illustrated for relevant white colors. Specifically, FIG. 14C illustrates the rendering performance of the five-channel array for a white colored light at 3200 K, 4500 K, and 5600 K (along with the corresponding output SPD).

The five-channel array has advantages as a custom five channel light array. In particular, the five-channel array achieves priority level 1 for both preference (P1) and fidelity (F1) under Annex E for a range of temperatures (e.g., 3200 K to 5600 K).

Figure 15A:
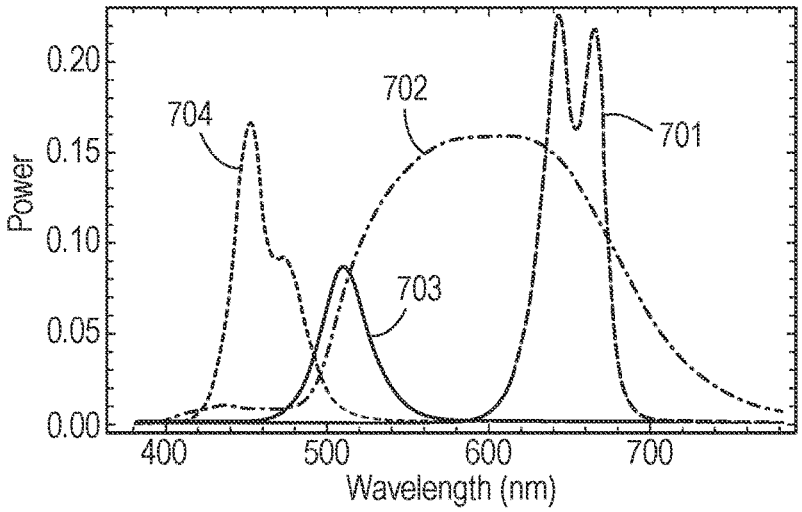
FIG. 15A illustrates emitter spectra of a four-channel array.
Figure 15B:
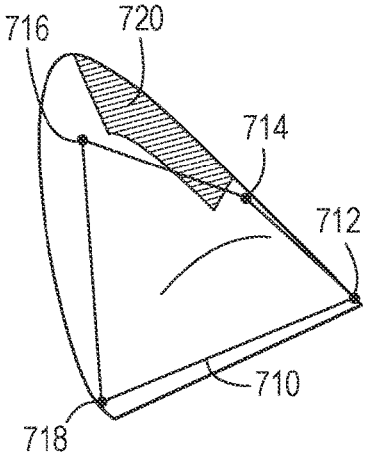
FIG. 15B is the CIE 1931 color space illustrating a color gamut of the four-channel array of FIG. 15A.
Figure 15C:
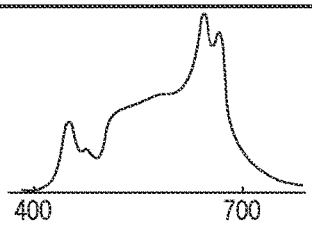
FIG. 15C illustrates the performance of the four-channel array of FIG. 15A.
Figure 15C:
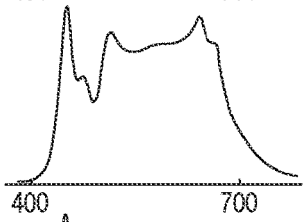
Figure 15C:
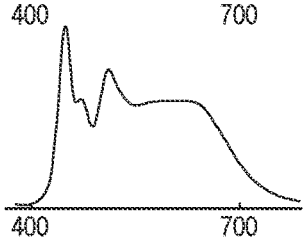

With reference to FIGS. 15A-15C, a fifth custom light array includes four LED channels with hybrid LED strings (a "hybrid four-channel array"). In the illustrated embodiment, three of the four channels are hybrid LED channels (i.e., have more than one color of LED electrically coupled together). For example, the red LEDs and the deep red LEDs are electrically coupled together on a single control channel ("channel 1") such that both the red LED and the deep red LED receive the same excitation current. In the illustrated embodiment, the hybrid four-channel array includes 6 red LEDs, 9 deep red LEDs, 18 custom yellow LEDs, 12 lime LEDs, 9 cyan LEDs, 3 blue LEDs, and 3 indigo LEDs for a total of 60 LEDs with the color mix shown in Table 12.

TABLE 12

| Hybrid Four-Channel Array | | | | | | | | |
|---|---|---|---|---|---|---|---|---|
| | | Per LED | | Per Channel | | | | |
| | LED Count | Optical Power (W) | Luminous Flux (lm) | Optical Power (W) | Luminous Flux (lm) | Power Ratio | Flux Ratio | |
| Red | 6 | 0.46 | 70 | 2.76 | 420 | 6.0% | 3.5% | Channel |
| Deep Red | 9 | 0.62 | 35 | 5.58 | 315 | 12.2% | 2.7% | 1 |
| Custom Yellow | 18 | 1 | 289 | 18 | 5202 | 39.2% | 43.9% | Channel 2 |
| Lime | 12 | 0.82 | 357 | 9.84 | 4284 | 21.4% | 36.2% | |
| Cyan | 9 | 0.38 | 139 | 3.42 | 1251 | 7.5% | 10.6% | Channel 3 |
| Blue | 3 | 0.77 | 80 | 2.31 | 240 | 5.0% | 2.0% | Channel |
| Indigo | 3 | 1.33 | 43 | 3.99 | 129 | 8.7% | 1.1% | 4 |
| Total | 60 | | | 45.9 | 11841 | 100% | 100% | |

With reference to FIG. 15A, the spectral power distribution for the hybrid four-channel array is illustrated with the spectral power distribution 701 for the red and deep red hybrid LED channel, the spectral power distribution 702 for the custom yellow and lime hybrid LED channel, the spectral power distribution 703 for the cyan LED, and the spectral power distribution 704 for the blue and indigo hybrid LED channel. In other words, FIG. 15A represents the emitter spectra according to one embodiment of the hybrid four-channel array. With reference to FIG. 15B, a corresponding color gamut 710 is achievable by the hybrid four-channel array. Specifically, the gamut 710 is illustrated in the CIE 1931 color space and connects the x,y coordinates 712 for the hybrid red and deep red, the x,y coordinate 714 for the hybrid custom yellow and lime, the x,y coordinate 716 for the cyan LED, and the x,y coordinate 718 for the hybrid blue and indigo.

With reference to FIG. 15C, the rendering performance of the hybrid four-channel array is illustrated for relevant white colors. Specifically, FIG. 15C illustrates the rendering performance of the hybrid four-channel array for a white colored light at 3200 K, 4500 K, and 5600 K (along with the corresponding output SPD).

The hybrid four-channel array has advantages as a custom four channel light array. By combining the custom yellow LED with a conventional lime LED in a hybrid channel, the hybrid four-channel can be used to create white light of high quality, while maintaining a familiar and desirable gamut. The quality of the hybrid four-channel array is further improved by using a hybrid channel of red and deep red. Hardwiring more than one colored LED together on a single channel to achieve a mixed color that is not otherwise available as a single LED is advantageous because it reduces the number of drivers required to control the light fixture.

With reference to FIG. 15B, the hybrid four-channel array does not include an emitter within the green eco-design exemption space 720 in the CIE 1931 color space, but the hybrid four-channel array is tunable to a color mix that does fall within the green eco-design exemption space 720. The eco-design exemption space 720 is the space defined by the Commission Regulation (EU) of Oct. 1, 2019 laying down eco-design requirements for light sources and separate control gears (Document No. 32019R2020), which is hereby incorporated by reference in its entirety. None of the emitters in the hybrid four-channel array have a dominant wavelength within a range of approximately 520 nanometers and approximately 570 nanometers. However, the hybrid four-channel array can maintain the eco-design exemption from efficacy requirements without having a conventionally nominal green LED that is within the exemption space 720. In other words, none of the hybrid channel chromaticities (e.g., 712, 714, 716, 718) fall within the exemption space 720, but the color gamut 710 does contain a portion of the exemption space 720.

As demonstrated by the example arrays described herein, a light fixture with a processor for driving the plurality of light emitting diodes to create a color mix, wherein at least one of the LEDs is the custom yellow LED has advantages. For example, the color mix can have a TM-30-18 Annex E priority level 1 for preference (P1) for a CCT range of approximately 3200 K to approximately 5000 K. Likewise, the color mix can have a CRI value of at least 90 for a CCT range of approximately 2400 K to approximately 5000 K. In addition, the color mix can have a TM-30-18 $R_f$ value of at least 95 for a CCT range of approximately 2400 K to approximately 5000 K.

Although the subject matter described herein has been described in detail with reference to certain embodiments, variations and modifications are possible in view of the above disclosure or may be acquired in association with making and/or using one or more of the disclosed embodiments.

What is claimed is:

1. A light emitting diode comprising:

a peak wavelength within a range of 600 nanometers and 630 nanometers;

a full width at half maximum value within a range of 140 nanometersto 160 nanometers; and a spectral power distribution that is asymmetrical and skewed about a center wavelength toward longer wavelengths;

wherein the light emitting didoe (34) has a spectral power distribution that reflects a skew normal distribution with a skew parameter within a range of 0.0 and −1.5.

2. A light fixture comprising:

a substrate; and a plurality of light emitting diodes mounted on the substrate, the plurality of light emitting diodes including:

a first light emitting diode according to claim 1.

3. The light fixture of claim 2, wherein the first light emitting diode has a total spectral energy with more than half the total spectral energy at wavelengths greater than 620 nanometers.

4. The light fixture of claim 2, wherein the first light emitting diode has a total spectral energy with less than 3% of the total spectral energy at wavelengths less than 480 nanometers.

5. The light fixture of claim 1, wherein the plurality of light emitting diodes includes a second light emitting diode with a different spectral power distribution than the first light emitting diode and a third light emitting diode with a different spectral power distribution than the first light emitting diode and the second light emitting diode.

6. The light fixture of claim 5, further including a processor for driving the plurality of light emitting diodes to create a color mix, wherein the color mix has a TM-30-18 Annex E priority level 1 desgin status for a CCT range of 3200 K to 5000 K.

7. The light fixture of claim 5, further including a processor for driving the plurality of light emitting diodes to create a color mix, wherein the color mix has a CRI value of at least 90 for a CCT range of 2400 K to 5000 K.

8. The light fixture of claim 5, further including a processor for driving the plurality of light emitting diodes to create a color mix, wherein the color mix has a TM-30-18 $R_f$ value of at least 95 for a CCT range of 2400 K to 5000 K.

9. The light fixture of claim 5, wherein the second light emitting diode has a peak wavelength within a range of 450 nanometers and 470 nanometers, and a full width at half maximum value within a range of 40 nanometers and 60 nanometers.

10. The light fixture of claim 9, wherein the third light emitting diode has a peak wavelength within a range of 650 nanometers and 670 nanometers, and a full width at half maximum value within a range of 30 nanometers and 55 nanometers.

11. The light fixture of claim 2, wherein the plurality of light emitting diodes are operated by four or fewer control channels.

12. The light emitting diode of claim 1, wherein the luminous efficacy of radiation is at least 240 lumens/watt.

13. The light emitting diode of claim 1, wherein the light emitting diode includes a dominant wavelength within a range of 580 nanometers and 600 nanometers.

14. The light emitting diode of claim 1, wherein the light emitting diode has a total spectral energy with more than half the total spectral energy at wavelengths greater than 620 nanometers.

15. The light emitting diode of claim 14, wherein the total spectral energy has less than 3% of the total spectral energy at wavelengths less than 480 nanometers.

16. The light emitting diode of claim 1, wherein the light emitting diode includes an excitation purity within a range of 89% and 93%.

17. The light emitting diode of claim 1, wherein the light emitting diode includes a CIE 1931 (x,y) chromaticity coordinate with an x-value within a range of 0.430 and 0.550 and a y-value within a range of 0.423 and 0.477.

* * * * *